US008950198B2

(12) United States Patent
Cording

(10) Patent No.: US 8,950,198 B2
(45) Date of Patent: Feb. 10, 2015

(54) METHOD AND SYSTEM FOR FILLING A REFRIGERANT INTO A REFRIGERATION SYSTEM

(75) Inventor: Louis Cording, Sonderborg (DK)

(73) Assignee: Mahle International GmbH (DE)

( * ) Notice: Subject to any disclaimer, the term of this patent is extended or adjusted under 35 U.S.C. 154(b) by 190 days.

(21) Appl. No.: 13/593,645

(22) Filed: Aug. 24, 2012

(65) Prior Publication Data

US 2013/0047636 A1 Feb. 28, 2013

(30) Foreign Application Priority Data

Aug. 24, 2011 (EP) ..... 11178649

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01)
USPC ..... 62/77; 62/149; 62/292

(58) Field of Classification Search
CPC ..... F25B 45/00; F25B 2345/003; F25B 2345/001
USPC ..... 62/77, 149, 292
See application file for complete search history.

(56) References Cited

U.S. PATENT DOCUMENTS

| | | | | |
|---|---|---|---|---|
| 3,461,686 | A * | 8/1969 | Andersen | 62/510 |
| 3,827,249 | A * | 8/1974 | Garland et al. | 62/174 |
| 4,938,031 | A * | 7/1990 | Manz et al. | 62/149 |
| 5,339,642 | A * | 8/1994 | Laukhuf | 62/77 |
| 5,758,506 | A * | 6/1998 | Hancock et al. | 62/77 |
| 5,875,638 | A * | 3/1999 | Tinsler | 62/149 |
| 6,158,234 | A * | 12/2000 | Szutu | 62/292 |
| 6,244,055 | B1 * | 6/2001 | Hanson et al. | 62/85 |
| 6,314,749 | B1 * | 11/2001 | Van Steenburgh, Jr. | 62/292 |
| 6,442,963 | B1 * | 9/2002 | Pfefferle et al. | 62/475 |
| 7,845,178 | B1 * | 12/2010 | Suharno et al. | 62/77 |
| 7,975,500 | B2 * | 7/2011 | Colnaghi et al. | 62/292 |
| 8,079,226 | B2 * | 12/2011 | Brown et al. | 62/149 |
| 8,429,921 | B2 * | 4/2013 | Suharno et al. | 62/77 |
| 2006/0130510 | A1 * | 6/2006 | Murray et al. | 62/292 |
| 2008/0276634 | A1 * | 11/2008 | Brown et al. | 62/149 |
| 2009/0158756 | A1 * | 6/2009 | Brown et al. | 62/77 |
| 2009/0241560 | A1 * | 10/2009 | Murray et al. | 62/77 |
| 2011/0061407 | A1 * | 3/2011 | McMasters | 62/77 |
| 2011/0146304 | A1 * | 6/2011 | Brown et al. | 62/77 |

FOREIGN PATENT DOCUMENTS

| | | |
|---|---|---|
| EP | 0 374 966 | 6/1990 |
| EP | 2 136 164 | 12/2009 |
| JP | 2006-10117 | 1/2006 |
| JP | 2006-207925 | 8/2006 |
| WO | WO 2006/066580 | 6/2006 |

* cited by examiner

*Primary Examiner* — Mohammad M Ali
(74) *Attorney, Agent, or Firm* — Rader, Fishman & Grauer PLLC

(57) ABSTRACT

A method of filling refrigerant into a refrigeration system by means of a filling system comprising a tank includes the step of pressurizing the tank by means of a conditioning process to a predetermined differential pressure above the saturation pressure of the actual ambient temperature before the refrigerant is filled into the refrigeration system.

13 Claims, 1 Drawing Sheet

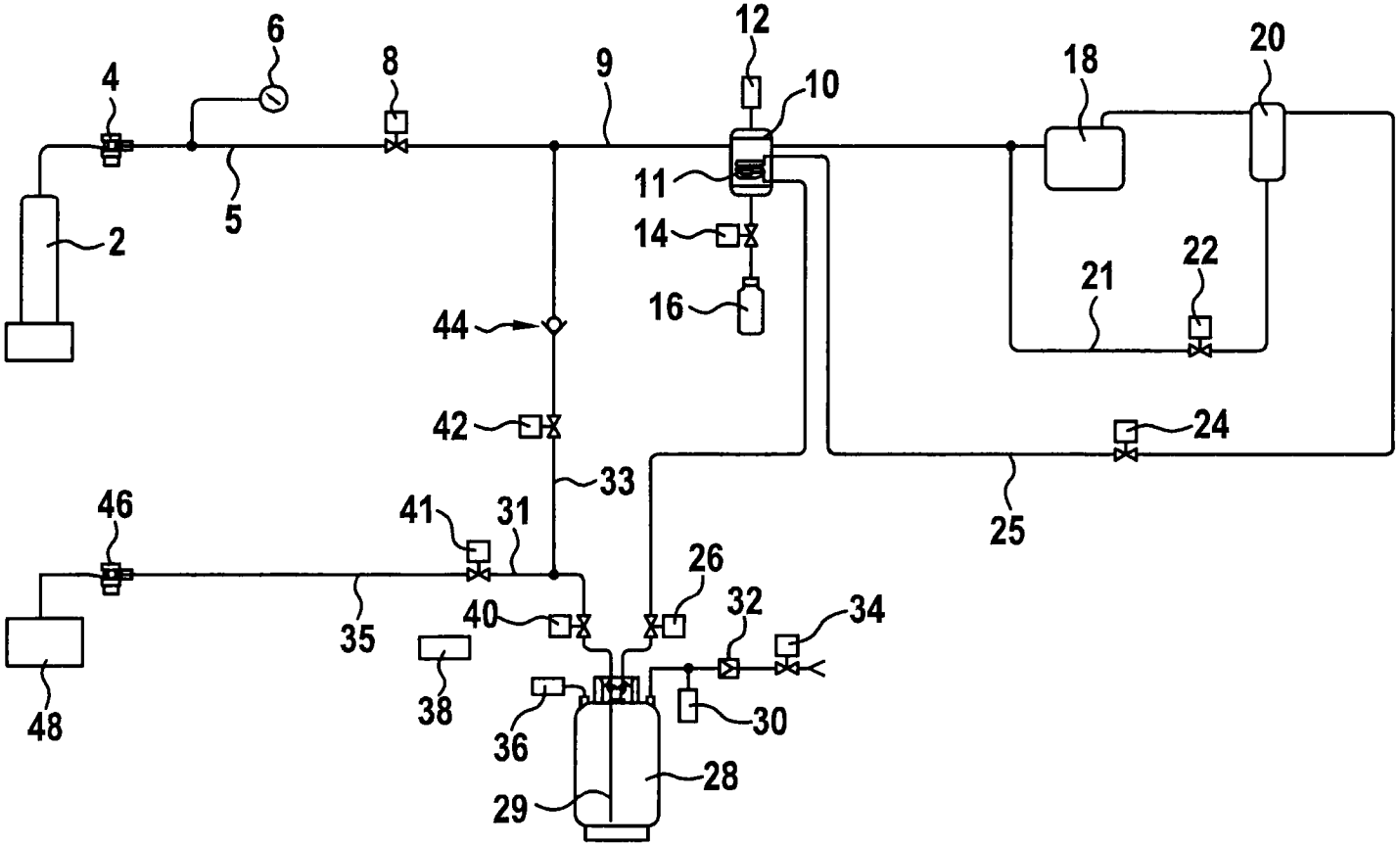
20
18
22
21
24
25
10
12
11
14
16
9
8
6
5
4
2
44
42
33
31
41
35
46
48
34
32
30
26
28
40
38
36
29

METHOD AND SYSTEM FOR FILLING A REFRIGERANT INTO A REFRIGERATION SYSTEM

CROSS REFERENCE

The present application claims the benefit under 35 U.S.C. 119 of European Patent Application No. 11178649.7 filed Aug. 24, 2011, which is expressly incorporated herein by reference in its entirety.

FIELD OF THE INVENTION

The present invention is directed to a method and a system for filling a refrigerant into a refrigeration system.

BACKGROUND INFORMATION

Refrigeration systems such as air conditioning systems (A/C systems), e.g., in vehicles such as cars, buses or trucks, etc. contain a refrigerant which is added during the manufacture of the refrigeration system. When the refrigeration system is serviced and repaired there is a need to extract the refrigerant from the system and to refill refrigerant into the system afterwards.

Systems for filling refrigerant into refrigeration systems usually comprise a charging adapter and a charging valve for charging fluid refrigerant into the refrigeration system. Ideally the charging valve would be placed in the charging adapter so that the conduit connecting the internal refrigerant tank with the charging adapter would be filled with liquid refrigerant and the "dead volume" between the charging valve and the charging port would be very small.

The conduit being filled with liquid would make sure that the amount of refrigerant leaving the charging valve would be the same as the amount leaving a tank of the filling system, which can be measured with high accuracy by a weight-cell.

Having the "dead volume" very small would cause that the variation of the actual charging amount would be small and a high accuracy could be achieved when then system is filled with the refrigerant.

In conventional filling systems, however, the charging valve is usually placed inside the machine, which results in a distance of a couple of meters between the charging hose and the charging valve. As a result, variation of the ambient temperature will greatly effect if the charging line and the hose are filled with liquid or vaporized refrigerant. As a consequence, the amount of refrigerant filled into the refrigeration system may be determined only with reduced accuracy.

SUMMARY

It is an object of the present invention to provide a method and a system for filling a refrigerant into a refrigeration system allowing to determine the amount of refrigerant filled into the refrigeration system with high accuracy.

An example method for filling a refrigerant into a refrigeration unit, e.g., an air conditioning system in a vehicle, by means of a filling system according to the invention includes a conditioning process comprising the step of pressurizing a tank of the filling system to a predetermined differential pressure above the saturation pressure of the actual ambient temperature before the refrigerant is transferred from the tank to the refrigeration system.

A filling system for performing the method according to an embodiment of the present invention comprises a compressor, which is configured for compressing the refrigerant from an external reservoir to a filling pressure, a pipe connection between the compressor and the filling place to the refrigeration system, and a refrigerant return line which is configured for returning the refrigerant to the low pressure side of the compressor. The filling system further comprises at least two temperature sensors, which are respectively configured for measuring the ambient temperature and the temperature of the refrigerant collected in the tank. The filling system is configured to operate the compressor in order to increase the temperature in the tank until a predetermined differential temperature above the actual ambient temperature is reached.

Another embodiment of a filling system for performing the method according to the present invention comprises a compressor, which is configured for compressing the refrigerant from an external reservoir to a filling pressure, a pipe connection between the compressor and the filling place to the refrigeration system, and a refrigerant return line which is configured for returning the refrigerant to the low pressure side of the compressor. The filling system further comprises a temperature sensor, which is configured for measuring the ambient temperature, and a pressure sensor, which is configured for measuring the pressure of the refrigerant in the tank. The filling system is configured to operate the compressor in order to increase the pressure in the tank until a predetermined differential pressure above the saturation pressure of the actual ambient temperature is reached.

Performing a conditioning process according to the present invention ensures that the tank is pressurized to a certain differential pressure with respect to the saturation pressure of the actual ambient temperature. In consequence, the inlet line is filled with liquid. The conditioning process further causes a large portion, in particular the majority, of the refrigerant to be vaporized. As the density of vaporized refrigerant is more than 40 times lower than the density of the liquid refrigerant, the variation of the amount of refrigerant left in the filling system's outlet hose will be smaller if the refrigerant is vaporized. The reduced variation results in an improved charging accuracy.

In an embodiment, the conditioning process is continued until a predetermined temperature difference between the temperature of the refrigerant collected in the tank an the ambient temperature is reached. By performing the conditioning process until a predetermined temperature difference between the temperature of the refrigerant stored in the tank an the ambient temperature is achieved, a predetermined accuracy of the amount of refrigerant filled into the refrigeration system may be reached.

In an embodiment, the predetermined temperature difference is determined based on the design of the filling system, as the temperature difference necessary in order to achieve a predetermined accuracy generally depends on the configuration of the respective filling system.

In an exemplary embodiment, the conditioning process continues until the temperature of the refrigerant in the tank is 11° C. higher than the ambient temperature in order to achieve an accuracy of the amount of refrigerant filled into the refrigeration system of +/−15 gram.

In an embodiment, the conditioning of the tank is done by means of a compressor, the compressor compressing the refrigerant and conveying the compressed and heated refrigerant into the tank. Refrigerant from the tank is returned to the low pressure inlet side of the compressor. This circulation of refrigerant is maintained until a predetermined differential pressure within the tank is reached. This process allows to condition the tank to a predetermined internal pressure easily.

In an embodiment, the refrigerant is heated before it is supplied to the compressor in order to vaporize the refrigerant and to ensure that no liquid refrigerant, which could damage the compressor, is supplied to the compressor. The refrigerant may be heated by means of heat exchange with the pressurized and heated refrigerant leaving the high pressure outlet side of the compressor. The heat exchange between the refrigerant leaving the compressor and the refrigerant entering the compressor may be performed by means of a heated suction accumulator. A low pressure, low temperature side of the heated suction accumulator is arranged upstream of the compressor, and a high pressure, high temperature side of the heated suction accumulator is arranged downstream of the compressor in order to transfer heat from the refrigerant leaving the compressor to the refrigerant entering the compressor.

In an embodiment the conditioning process continues until the majority of the refrigerant filled into the refrigeration system is vaporized. As the density of vaporized refrigerant is more than 40 times lower than that of the liquid refrigerant, the variation of the amount of refrigerant left in the charging hose will be smaller. This results in an improved charging accuracy.

The present invention is described in more detail with reference to the FIGURE.

BRIEF DESCRIPTION OF THE DRAWING

The FIGURE shows a schematic view of an example embodiment of a filling system according to the present invention.

DETAILED DESCRIPTION OF EXAMPLE EMBODIMENTS

An external pressure bottle 2 filled with a fluid refrigerant to be supplied to the system is connected by means of a system inlet (low pressure) coupling 4 to a charging hose 5 of the filling system. The charging hose 5 is provided with an inlet pressure sensor 6 which is configured to measure the pressure of the refrigerant supplied by the external pressure bottle 2 to the inlet hose 5.

The opposing end of the inlet hose 5 is connected by means of a switchable inlet valve 8 to an inlet line 9 which supplies the refrigerant delivered by the external pressure bottle 2 to a heated suction accumulator 10. The heated suction accumulator 10 is configured to heat the refrigerant, if necessary, in order to ensure that all the refrigerant is vaporized. A heated suction accumulator pressure sensor 12 is located at the heated suction accumulator 10 in order to measure the pressure of the refrigerant collected within the heated suction accumulator 10.

An oil drain valve 14 and an oil drain 16 are serially connected to the bottom of the heated suction accumulator 10 in order to drain oil, which has been separated from the refrigerant within the heated suction accumulator 10 and collected at the bottom of the heated suction accumulator 10.

An outlet side of the heated suction accumulator 10 is fluidly connected to a low pressure inlet of a compressor 18, the compressor 18 being configured for compressing the refrigerant to an increased pressure level.

A high pressure outlet side of the compressor 18 provides pressurized refrigerant and is fluidly connected to an oil separator, which is configured for separating oil, which is used for lubricating the compressor 20 and a portion of which is added to the refrigerant in the compressor 18, from the refrigerant. The oil separated by the oil separator 20 is delivered via an oil return line 21 and an oil return valve 22 15 back to the inlet side of the compressor 18 in order to avoid that the compressor 18 runs out of oil after some time of operation. The compressor 18 running out of oil may result in a jamming and/or even serious damage of the compressor 18.

The pressurized refrigerant leaving the oil separator 20 flows through a high pressure line 25 comprising a compressor outlet valve 24 to a heating coil 11, which is arranged within the heated suction accumulator 10 in order to transfer heat from the high pressurized, high temperature refrigerant leaving the compressor 18 to the low pressure refrigerant before it flows into the compressor 18, in order to ensure that only vaporized refrigerant enters into the compressor 18, as it has been described before.

After having left the heating coil 11 the refrigerant is delivered via a tank inlet valve 26 into a tank 28 of the filling system. The tank 28 is provided with a tank temperature sensor 36 which is configured for measuring the temperature of the refrigerant collected within the tank 28. The tank 28 is also provided with a tank pressure sensor 30 which is configured for measuring the pressure of the refrigerant collected within the tank 28. An orifice 32 and a venting valve 34 fluidly connected to the tank 28 allow to vent the tank 28 by delivering excessive gas/air from the tank 28 to the environment.

The tank 28 is further provided with a tank outlet line 29 comprising a tank outlet valve 40 allowing to extract pressurized refrigerant from the tank 28.

Downstream of the tank outlet valve 40 the tank outlet line 29 branches into a system outlet line 31, which is fluidly connected to an refrigeration unit 48 by means of a system outlet valve 41, an outlet hose 35 and a high pressure outlet coupling 46, and a refrigerant return line 33 fluidly connecting the tank outlet line 29 with the inlet line 9, which is connected to the inlet side of the heated suction accumulator 10.

The refrigerant return line 33 comprises a switchable refrigerant return valve 42, which allows to control the flow of refrigerant through the refrigerant return line 33, and a one-way-valve 44, which inhibits an undesired flow of refrigerant from the inlet line 9 to the tank outlet line 29.

In order to fill refrigerant into the refrigeration unit 48, an external gas bottle 2 filled with fluid refrigerant to be supplied to the system may be connected by means of the system inlet (low pressure) coupling 4 to the charging hose 5 of the filling system. The switchable inlet valve 8 is opened and the compressor 18 operates in order to suck refrigerant from the external gas bottle 2 and pressurize it. The pressurized refrigerant is delivered via the oil separator 20, the compressor outlet valve 24, the high pressure line 25, and the heating coil 11 into the tank 28.

For an example conditioning process according to the present invention, the tank outlet valve 40 and the refrigerant return valve 42 are opened and the system outlet valve 41 is closed in order to deliver refrigerant from the tank 28 through the refrigerant return line 33 and the heated suction accumulator 10 back to the inlet side of the compressor 18 circulating the refrigerant in the filling system. The temperature and the pressure of the refrigerant collected within the tank 28 are measured by means of the tank temperature sensor 36 and the tank pressure sensor 30, respectively. Additionally, the temperature of the ambient air is measured by means of an ambient air temperature sensor 38.

This conditioning process is continued until the temperature of the refrigerant collected within the tank 28, which is measured by means of the tank temperature sensor 36, exceeds the temperature of the ambient air, which is measured by means of the ambient air temperature sensor 38, by a predetermined temperature difference of, e.g., 11° C.

When the predetermined temperature difference is reached, the refrigerant return valve 42 is closed and the system outlet valve 41 is opened in order to deliver the pressurized refrigerant from the tank 28 via the outlet hose 35 and the outlet coupling 46 to the refrigeration unit 48.

If the tank 28 comprises enough refrigerant to be supplied to the refrigeration system, it is not necessary to add additional refrigerant from the external gas bottle 2. In this case, the inlet valve 8 remains closed and the refrigerant comprised in the tank 28 is circulated by the described conditioning process in order to increase the pressure in the tank 28 before the refrigerant is supplied from the tank 28 to the refrigeration unit 48.

By means of the conditioning process as its has been described above, the tank 28 is pressurized to a certain differential pressure above the saturation pressure of the actual ambient temperature. In consequence, the tank outlet line 29 and the system outlet line 31 connecting the tank 28 with the system outlet valve 41 15 are completely filled with liquid.

The conditioning process further assures that the majority of the refrigerant is vaporized. As the density of vapor refrigerant is more than 40 times lower than that of the liquid refrigerant, the variation of the amount of refrigerant left in the system outlet hose 35 will be small. As a result, the amount of refrigerant charged into the refrigeration unit 48 may be determined with improved accuracy.

The conditioning process may be performed parallel to the evacuation of the refrigeration system in order to reduce the service time of the refrigeration system. The oil drain may be performed at the same time, as well.

The conditioning also may be done in an idle mode of the system in order to prepare the system for a later filling operation.

What is claimed is:

1. A method of filling a refrigerant into a refrigeration system using a filling system including a tank, the method comprising:

pressurizing the tank using a conditioning process to a predetermined differential pressure above a saturation pressure of an actual ambient temperature before the refrigerant is transferred from the tank to the refrigeration system, the tank conditioning process including circulating the refrigerant from the tank through a heated suction accumulator by:

opening a tank outlet valve in an outlet line that runs from the tank to the refrigeration system;

opening a refrigerant return valve in a refrigerant return line connecting the outlet line with an inlet line upstream of the heated suction accumulator; and closing a system outlet valve in the outlet line downstream of the connection point of the refrigerant return line.

2. The method of claim 1, wherein the conditioning process continues until a predetermined temperature difference between a temperature of the refrigerant in the tank and the ambient temperature has been reached.

3. The method of claim 2, wherein the predetermined temperature difference is determined based on a design of the filling system.

4. The method of claim 2, wherein the conditioning process continues until the temperature of the refrigerant in the tank is at least 11° C. higher than the ambient temperature.

5. The method of claim 1, wherein the pressurizing is done by means of a compressor, and the method further comprising:

conveying refrigerant, which has been compressed by the compressor, to the tank, extracting refrigerant from the tank; and returning expanded refrigerant to an inlet side of the compressor;

wherein circulation of refrigerant is maintained until the predetermined differential pressure above the saturation pressure of the actual ambient temperature is achieved.

6. The method of claim 5, wherein the refrigerant is vaporized before it is supplied to the compressor.

7. The method of claim 6, wherein the conditioning process continues until a majority of the refrigerant in the tank is vaporized.

8. A filling system for filling a refrigerant in a tank into a refrigeration system, the filling system comprising:

a compressor configured to compress the refrigerant, a fluid connection fluidly connecting the compressor to the refrigeration system;

a refrigerant return line connecting an outlet line and an inlet line and configured to return the refrigerant from the tank to a low pressure side of the compressor, the refrigerant return line having a switchable refrigerant return valve and a one-way valve located downstream of the refrigerant return valve; and at least two temperature sensors which are respectively configured for measuring a temperature of the refrigerant in the tank and an ambient temperature;

wherein the filling system is configured to operate the compressor to increase the temperature in the tank until a predetermined differential temperature above an actual ambient temperature has been reached.

9. The filling system of claim 8, further comprising a venting valve and an orifice fluidly connected to the tank and a pressure sensor configured to measure pressure of the refrigerant in the tank, the venting valve and the orifice being configured to vent excess gas from the tank to the environment.

10. A filling system for filling a refrigerant in a tank into a refrigeration system, the system comprising:

a compressor configured to compress the refrigerant, a fluid connection fluidly connecting the compressor to the refrigeration system;

a refrigerant return line connecting an outlet line and an inlet line and configured to return the refrigerant from the tank to a low pressure side of the compressor, the refrigerant return line having a switchable refrigerant return valve and a one-way valve located downstream of the refrigerant return valve;

a temperature sensor configured to measure ambient temperature; and a pressure sensor configured to measure pressure of the refrigerant in the tank;

wherein the filling system is configured to operate the compressor to increase the pressure in the tank until a predetermined differential pressure above a saturation pressure of the actual ambient temperature has been reached.

11. The filling system of claim 8, further comprising:

a heated suction accumulator configured to evaporate the refrigerant before it is supplied to the compressor.

12. The filling system of claim 10, further comprising:

a heated suction accumulator configured to evaporate the refrigerant before it is supplied to the compressor.

13. The filling system of claim 10, further comprising a venting valve and an orifice fluidly connected to the tank and the pressure sensor, the venting valve and the orifice being configured to vent excess gas from the tank to the environment.

* * * * *